US006293722B1

(12) United States Patent
Holbrook et al.

(10) Patent No.: US 6,293,722 B1
(45) Date of Patent: Sep. 25, 2001

(54) BINDER MECHANISM

(75) Inventors: Paul R. Holbrook, Buffalo Grove; Kenneth John Bargo, Chicago; John James Dwyer, Lakeville, all of IL (US); John Andrew Johnson, Seattle, WA (US); Timothy Edward McKeown, Glen Ellyn, IL (US); Rodney Hal Monson, Evanston, IL (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/396,787

(22) Filed: Sep. 15, 1999

(51) Int. Cl.[7] ..... B42F 3/04

(52) U.S. Cl. ..... 402/35; 402/26; 402/31; 402/36; 402/37; 402/38; 402/39; 402/40; 402/41; 402/42; 402/43; 402/45; 402/46; 402/55; 402/56

(58) Field of Search ..... 402/26, 31, 35, 402/36, 37, 38, 39, 40, 41, 42, 43, 45, 46, 55, 56

(56) References Cited

U.S. PATENT DOCUMENTS

| | | | | |
|---|---|---|---|---|
| 792,389 | * | 6/1905 | Boehner | 402/55 |
| 936,448 | * | 10/1909 | Hamacher | 402/39 |
| 968,657 | * | 8/1910 | Hamacher et al. | 402/39 |
| 2,179,627 | * | 11/1939 | Handler | 129/24 |
| 2,322,595 | * | 6/1943 | Schade | 402/31 |
| 3,255,759 | * | 6/1966 | Dennis | 402/56 |
| 4,486,112 | * | 12/1984 | Cummins | 402/55 |
| 5,692,847 | * | 12/1997 | Zane et al. | 402/31 |
| 5,692,848 | * | 12/1997 | Wada | 402/37 |
| 5,718,529 | * | 2/1998 | Chan | 402/36 |
| 5,827,004 | * | 10/1998 | Kim | 402/46 |
| 5,895,164 | * | 4/1999 | Wu | 402/31 |
| 5,975,784 | * | 11/1999 | Whaley | 402/31 |
| 5,975,785 | * | 11/1999 | Chan | 402/36 |
| 6,036,394 | * | 3/2000 | Cheng | 402/26 |

FOREIGN PATENT DOCUMENTS

| | | | | |
|---|---|---|---|---|
| 1409251 | * | 7/1965 | (FR) | 402/31 |

* cited by examiner

*Primary Examiner*—A. L. Wellington
*Assistant Examiner*—Mark T. Henderson
(74) *Attorney, Agent, or Firm*—Pennie & Edmonds LLP

(57) ABSTRACT

A binder mechanism is disclosed having a first ring assembly and a binding portion. The first ring assembly includes at least one first ring half. At least the first ring assembly or the binding portion are a pivotable half that is pivotable with respect to the other to a locked position about a first longitudinal axis. In the locked position, the first ring half is engaged with the binding portion cooperatively defining a loop that is substantially closed to retain a stack of papers or a workpiece. The first ring assembly and the binding portion are lockable with respect to each other in the locked position to prevent pivoting of the pivotable half from the locked position. At least one of the first ring assembly and the binding portion is movable with respect to the other from the locked position in an unlocking direction oriented at less than 180° from the longitudinal axis to permit the pivotable half to pivot about the longitudinal axis to an open position in which the loop is substantially open.

26 Claims, 8 Drawing Sheets

BINDER MECHANISM

BACKGROUND OF THE INVENTION

Binders, including those attached in folders, traditionally have opposing ring halves that may separate and come together to form open or closed loops. The ring halves are received within holes punched through a stack of paper or the workpiece to be temporarily bound by the closed loops. Traditionally, ring binders have half rings mounted on the springs that are biased against each other by a cover. The ring halves may be pulled apart from each other, targeting the leaf springs to an opened position. The ring halves may also be pushed towards each other, targeting the leaf springs to a closed position. Typically, the ring halves will snap between the open and close positions.

U.S. Pat. No. 2,179,627 discloses a loose leaf binder with toggle plates mounted with a spring back. A handle rotates a pinion to move the toggle plates longitudinally relative to each other other, together with curved sheet rataining prongs attached to the toggle plates. As the toggle plates are moved, a projection cams a toggle plate to open the rings formed by the retaining process. Upon further rotation of the handle, the toggle plates are forced by the spring back to return their relative angle or position.

SUMMARY OF THE INVENTION

A binder mechanism comprises a first ring assembly and a binding portion. The first ring assembly includes at least one first ring half. At least the first ring assembly or the binding portion are a pivitable half that is pivotable with respect to the other to a locked position about a first longitudinal axis. In the locked position, the first ring half is engaged with the binding cooperatively defining a loop that is substantially closed to retain a stack of papers or a workpiece. The first ring assembly and the binding portion are lockable with respect to each other from the locked position to prevent pivoting of the povitable half from the locked position. At least one of the first ring assembly and the binding portion is movable with respect to the other the from the locked position in an unlocking direction oriented at less than 180° from the longitudinal axis to permit the pivot about the longitudinal axis to an open position in which the loop is substantially open.

Preferably, the binding portion includes a second ring assembly that has at least one second ring half disposed generally laterally from the first ring half forming at least one ring half pair. The ring half forms the loop. Preferably, the first ring assembly is resiliently baised towards the open position. A spring may be provided connected between the first ring assembly the binding potion for biasing the first ring assembly towards the open position. Preferably, at least one first ring half includes at least one first locking half and the binding portion includes a second locking half lockable to the first locking half. The second locking half is unlockably from the first locking half by moving either the first assembly or the binding portion in the unlocking direction. Preferably, the second ring assembly includes the second locking half.

Additionally, at least one of the first and second locking halves of the ring half pair may include a protrusion and the other of the half pair may include a stop. The protrusion would be engageable against the stop in the locked position to prevent pivoting of the pivotable half about the first longitudinal axis. Further, at least one first ring half may include a proximal ring half disposed relative to the locking half such that the proximal ring half contacts the binding portion prior to the locking half when the pivotable half is pivoted towards the locked position. Preferably, the proximal ring half is not lockable to the binding portion in the locked position.

The first ring assembly may also include a first platform to which the proximal and locking portions are mounted. The proximal ring halves are preferably mounted on the platform in a pivoting direction about the longitudinal axis and are closer to the binding portion than the locking half. Additionally, the platform is preferably resiliently deformable such that in the locking position the platform biases the proximal portion against the binding portion and the locking portion away therefrom in the closed position. More preferably, proximal ring halves are positioned on each side of the locking half. Additionally, a cam engageable with at least one of the first ring assembly and the binding portion may be provided to cam the ring assemblies generally along the longitudinal axis to lock in the locked position.

Preferably, the first ring assembly and the binding portion are each pivotably connected to a base. More preferably, the pivotal connection is a pinned hinge. The binding portion may be pivotably connected to the base about a second longitudinal axis substantially parallel to the first longitudinal axis. Preferably, the base includes a first base portion pivotably connected to the first ring assembly, a second base portion pivotably connected to the binding portion, with the first and second base portions connected to each other and longitudinally movable with respect to each other in the unlocking direction.

A pivot spring may be provided to resiliently bias the first ring assembly towards the open position about the first longitudinal axis. Additionally, a translation spring may be provided for biasing the first base portion with respect to the second base portion in a locking direction opposite from the locking position. This retains the first locking half in locked association with the binding portion when in the locked position.

A lever may also be provided connected between the first ring assembly and the binder portion such that rotation of the lever displaces the first ring assembly with respect to the binding portion in the unlocking direction. Preferably, the lever has a blocking portion to block relative movement in the unlocking direction between the first ring assembly and the binding portion.

In another embodiment, the binder mechanism includes a first ring assembly pivotable along a first longitudinal axis. The first ring assembly includes at least one first ring half. A second ring assembly is provided that includes at least one second ring half disposed generally laterally from the first ring half forming at least one ring half pair. The first and second ring assemblies are lockable with respect to each other in a locked position in which the ring half pair defines a loop that is substantially closed to retain a stack of papers or workpiece. At least one of the first and second ring assemblies is movable with respect to the other in an unlocking direction oriented at less than 180° from the longitudinal axis to permit the first ring assembly to pivot about the longitudinal axis to an open position in which the loop is substantially open.

DETAILED DESCRIPTION OF THE PREFERRED EMBODIMENTS

Figure 1:
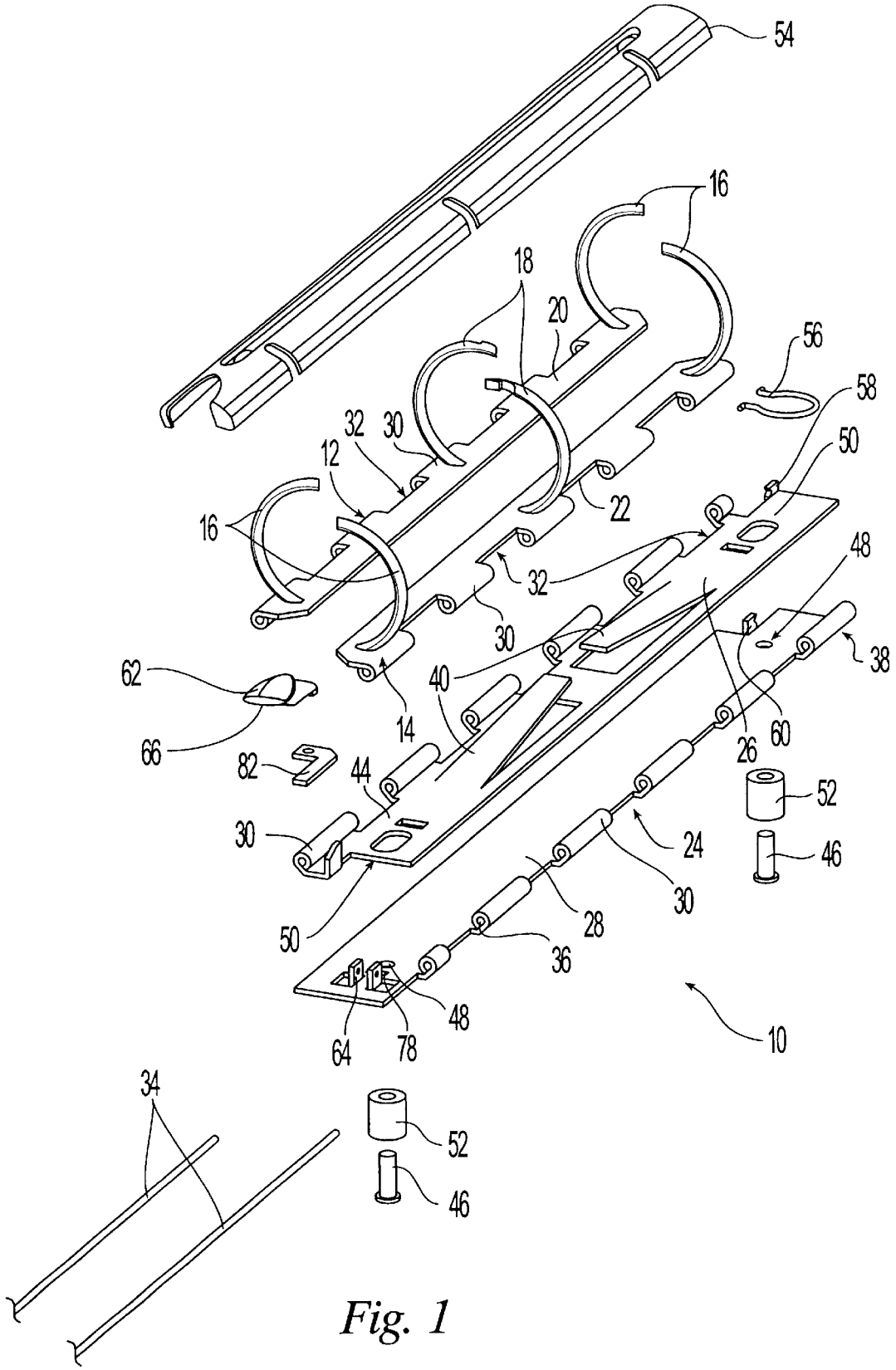
FIG. 1 is an exploded perspective view of a binder mechanism constructed according to the present invention.

Referring to FIG. 1, the preferred embodiment of a binder mechanism 10 of the present invention includes opposing binder portions, which are preferably a left and a right ring assembly 12 and 14. Each ring assembly 12 and 14 includes at least one, and preferably three, ring halves 16 and 18. The ring halves are mounted to platforms, which are preferably pivotable leaves 20 and 22. The ring halves 16 and 18 are preferably welded or brazed to the leaves, but can be fixed by alternative methods, such as derivating. Each ring half 16 and 18 is preferably curved, but may have a different shape, such as straight portions, or may have complex curves.

The ring assembly 12 and 14 are pivotably connected to base 24, which includes inner slider 26 and outer slider 28. Both the leaves 20 and 22 and the base portions or sliders 26 and 28 include hinge knuckles 30 spaced by recesses 32. The knuckles 30 of the left leaf 20 are intermeshed with the knuckles 30 of the inner slider 26 and the recesses 32 thereof, vice versa. Similarly, the knuckles 30 of the right leaf are intermeshed with the knuckles 30 of the outer slider 28 and the recesses 32 thereof, and vice versa. Hinge pins 34 are received through aligned holes 36 for each of the intermeshed knuckles, forming hinges 38. Preferably, the hinges 38 are penal hinges as shown, however, separate butt hinges may be attached to the leaves and sliders of a suitable hinge type include living hinges. The preferred leaves 20 and 22 and sliders 26 and 28 are formed from sheet metal, with rolled hinges. The preferred sheet metal in the leaves 20 and 22 are doubled over each other in the preferably flat portion thereof to which the ring halves are mounted to provide additional structural support thereto. Alternately, these components may be welded, or otherwise formed, from metals, plastics or other suitable materials. The leaves, described above are preferably stiff yet elastic.

Figure 2:
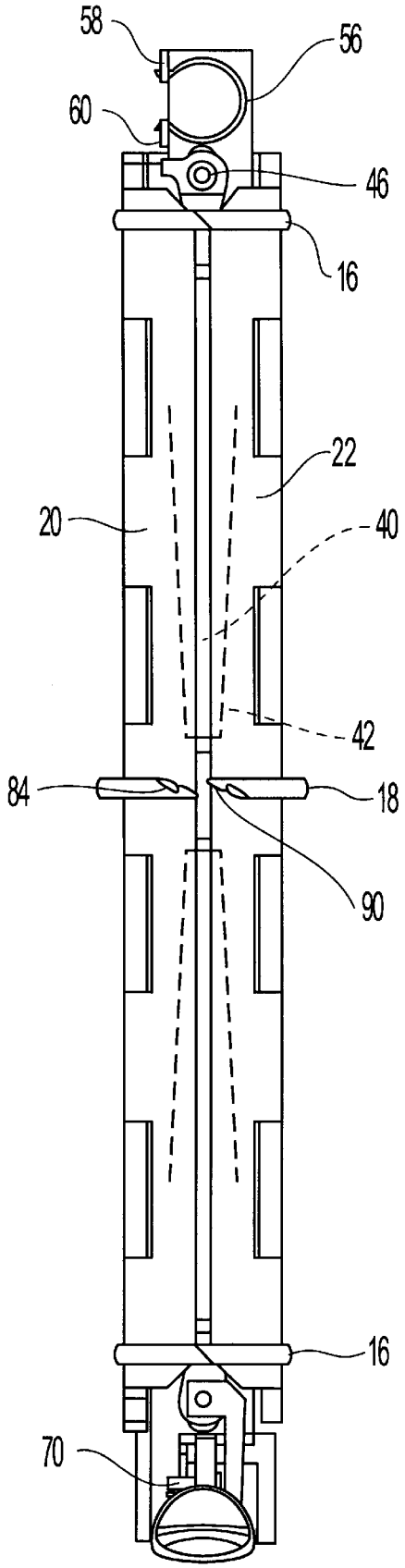
FIG. 2 is a top view of the binder assembly with the cover removed in a partially closed position.

The inner slider 26 includes rotational springs 40, which are preferably disposed towards the center thereof. The springs 40 are preferably leaf springs cut out from the sheet material of the inner slider 26. Springs 40 are bent towards the leaves 20 and 22, biasing the leaves 20 and 22 to move the opposing ring halves 16 and 18 from each other towards an open position. As shown, springs 40 preferably contact the underside of the leaves 20 and 22. As shown in FIG. 2, springs 40 are preferably tapered towards their free ends 42, such that they are softer near the free end 42 and stiffer where they meet the plate portion 44 of the slider 26. The free ends of the leaf spring preferably abut the leaves 20 and 22 adjacent the center ring halves 18.

Referring to FIG. 1, rivets 46 extend through openings 48 and 50 in the outer and inner sliders 26 and 28. Openings 48 have a similar diameter to the rivets to preferably restrict movement between the outer slider 28 and the rivets 46. Openings 50, however, are longitudinally longer than the diameter of the rivets 46 to allow longitudinal sliding of the inner slider 26.

Beyond the base 24, the rivets 46 pass through spacers or standoffs 52 which abut cover 54. The cover 54 is supported by standoff 52 at a predetermined height above the base 24. The rivets 46 thus preferably maintain the entire structure of the binder mechanism 10 during an assembled configuration. Preferably, the rivets 46 are also passed through a folder, such as through the spine, front or back cover.

Translation spring 56 is preferably compressed between spring seats 58 and 60, which are preferably upstanding portions of the inner and outer sliders 26 and 28. Translation spring 56 biases the sliders 26 and 28 longitudinally with respect to each other in a blocking direction, which is explained below, retaining ring halves 18 in locking association. In the preferred embodiment, the longitudinal direction is substantially parallel to the hinge axis of hinges 38.

Figure 3:
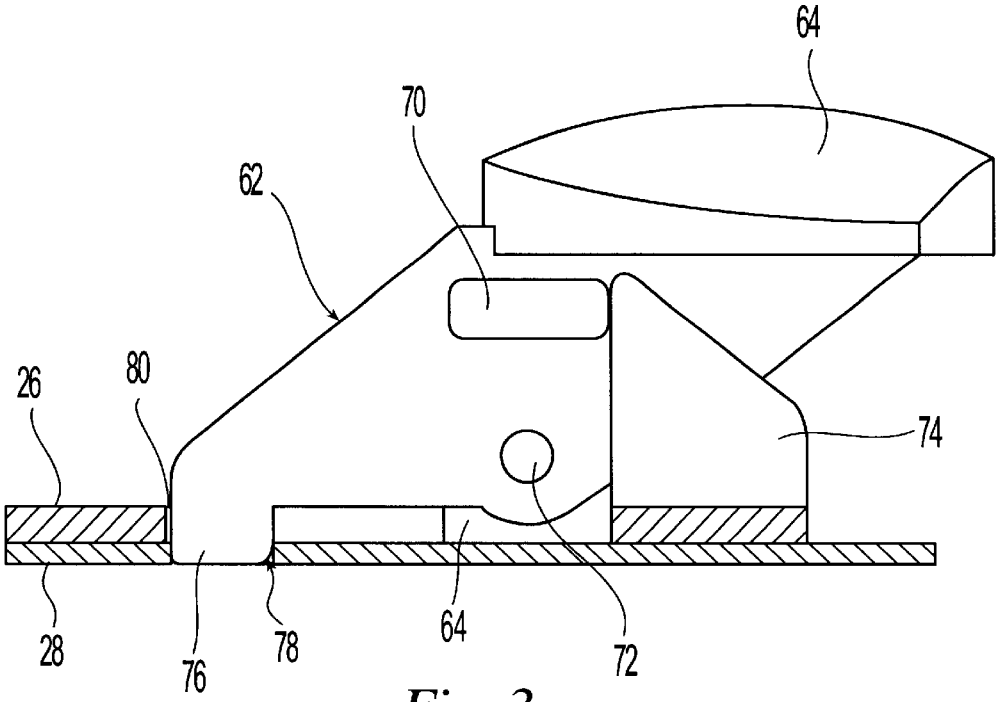
FIGS. 3 and 4 are side views of a button of the binder mechanism.

A button 62 is pivotably mounted on the base 24. Preferably, the button 62 is pivotably mounted to the outer slider 28, preferably to lever pivotable bracket 64. As shown in FIG. 3, a pivot pin 72, which may be a separate pin, or formed as part of the button 62 or bracket 64, pivotably joins the button to the bracket. The button 62 has a depressable portion 66 and a button cam portion 70, which is preferably in the back surface of the button 68, which most preferably is part of a laterally extending extension 70. Button cam portion 70 is disposed adjacent upstanding base cam 74, most preferably is fixed to the inner slider 26. The button 62 and the base cam portion 74 are associated such that when the button portion 66 is depressed, the button pivots back against the base cam portion 74, displacing the inner slider 26 in an unlocking direction with respect to the outer slider 28, as the button 62 pivots about its axis on the outer slider 28.

Figure 4:
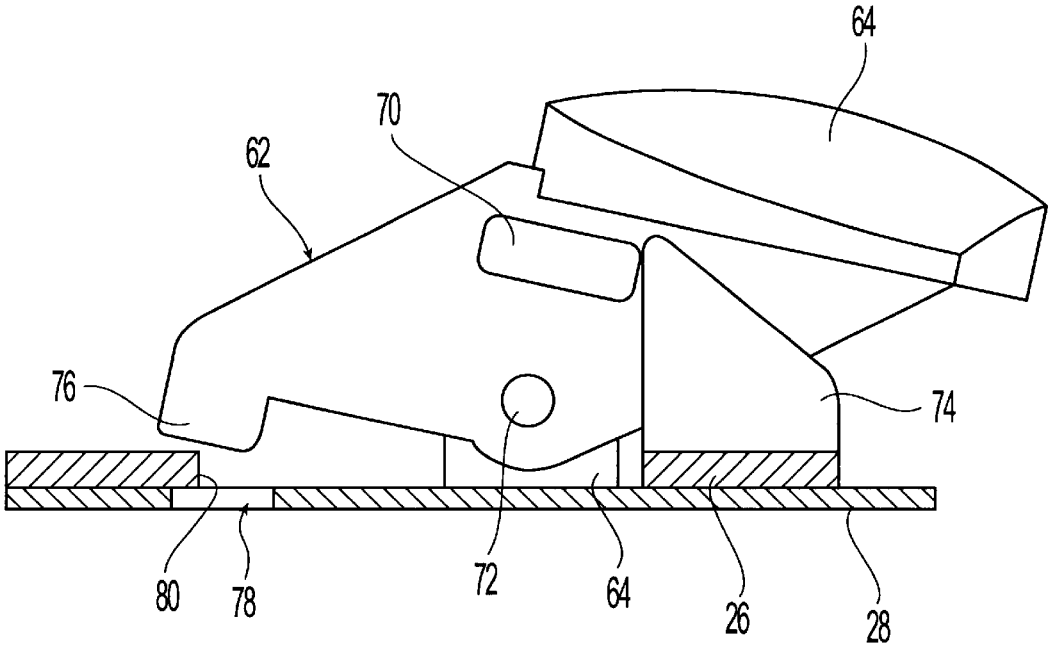

The button 62 also includes a blocking portion 76, which extends through opening 78 in the outer slider 28 of the base 24. The forward end of the blocking portion is adjacent a blocked edge 80 of the inner slider 26 to prevent or limit longitudinal displacement of the inner slider 26 with respect to the outer slider 28 upon a force supplied and directly against the ring halves 16 and 18. As shown in FIG. 4, the button 62 is depressed, the blocking portion 76 is lifted out of the opening 78 and beyond the blocked edge 80, allowing the slider 26 to be displaced by the extension 70 of the button.

Figure 5:
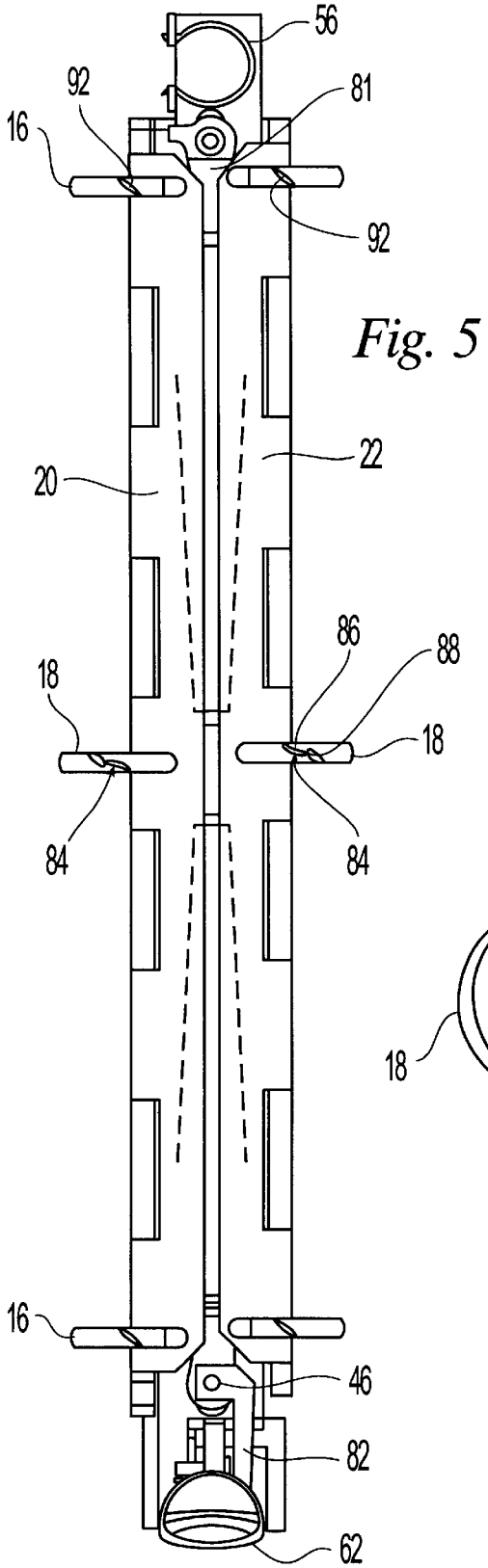
FIG. 5 is a top view of the binder mechanism with the cover removed in an unlocked longitudinal position.

Referring to FIG. 5, the button 62 is shown depressed, with the inner slider 26 and the left leaf 20 translated rearwardly, in an unlocking direction, and generally aligned with the hinge axis 38, further compressing the translation spring 56, whereas in FIG. 2, the left and right leaves 20 and 22 and opposing ring halves 16 and 18 are substantially aligned in lateral direction, and FIG. 5, the ring halves 16 and 18 and leaves 20 and 22 are offset by a distance sufficient to unlock the locking rings 18 from each other.

The base includes a translation stop 81 mounted to rivet 46, which prevents further movement of the inner slider 26 past the longitudinal position at which the present pair of ring halves 16 and 18 are aligned with each other. A button spring 82 is preferably mounted to the rivet 46 and has a leaf spring portion that biases the button in a forward direction, the position is shown in FIGS. 2 and 3.

Figure 8:
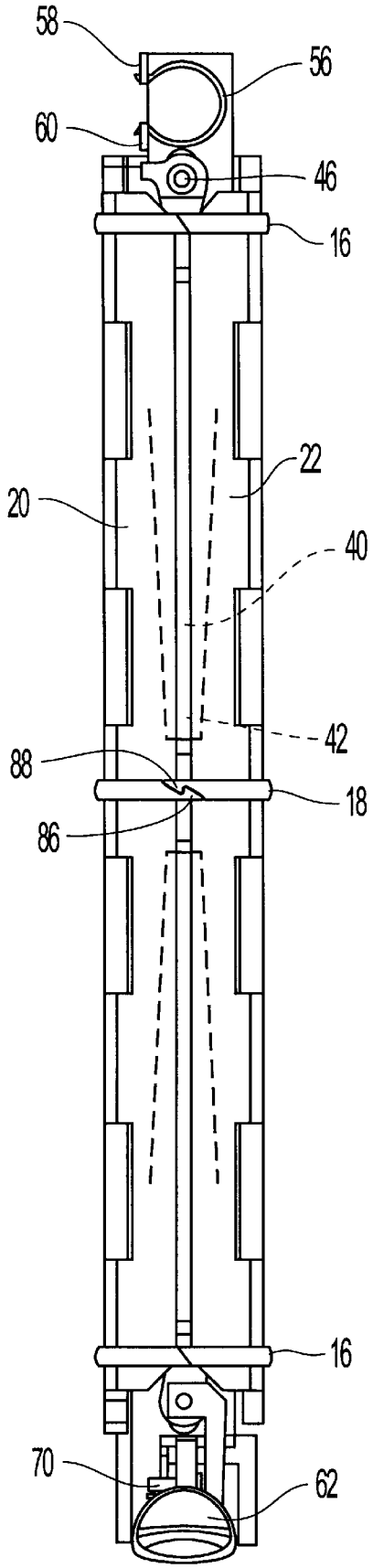
FIG. 8 is a top view of the binder mechanism in a closed position.
Figure 9:
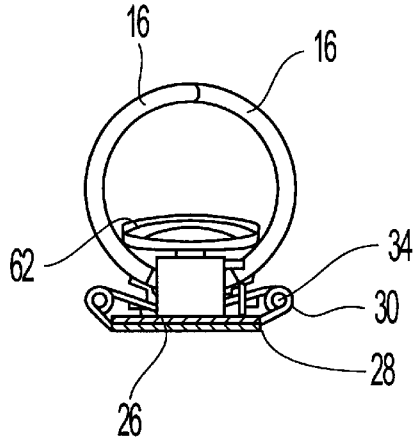
FIG. 9 is a end view thereof.

Referring to FIG. 5, locking rings 18 preferably have locking portions 84 at the forward ends, which are configured to cooperatively lock to each other when the rings are in a closed position, as shown in FIGS. 8 and 9. The locking portions 84 most preferably include protrusions 86 and stops 88. When the locking portions are locked together, the protrusion extends laterally into a recess of the locking portion 84 of the opposite ring halve 18, and engages the locking stop 88 thereof, such that pivoting of the ring halves of the open position, as shown in FIG. 5, is prevented.

In an alternative embodiment of the invention, the locking portions 84 may be disposed in other parts of the binder mechanism 10, such as in the base, and they include other suitable locking mechanisms as known in the art. Preferably, however, the locking portions 84 dispose the tips of the locking rings 18 so that the locking rings 18 may be pressed together by the fingers of a user, as shown in FIG. 2, in which the rings 16 and 18 are laterally aligned with each other, and longitudinally the locking position. Preferably, as shown in FIG. 1, the locking portions 84 also include a locking cam 90 facing the opposing locking portions 84 to cam or displace the locking portions 84 longitudinally with respect to each other, permitting the locking portions 84 to slide into engagement with each other.

As shown in FIG. 5, ring halves 16, preferably do not have locking portions, but instead have surfaces 92 that are preferably angled to permit the ring halves 16 to slide in the unlocking direction with respect to each other. The proximal ring halves 16 are preferably not lockable to each other. The surfaces 92 face each other, and preferably lock, but may be curved or may include several flat surfaces disposed at different angles and including a surface that is parallel to a longitudinal axis of the binder mechanism 10. In an alternative embodiment, all of the ring halves 16 and 18 may include locking portions, but it is preferred that only one of the opposing pairs of ring halves include the locking portions to facilitate closing and locking of the binder.

Figure 7:
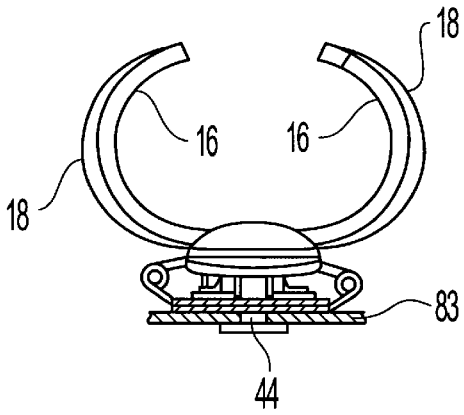
FIG. 7 is a end view thereof.

As shown in FIGS. 5 and 7, the ring halves 16 and 18 are mounted to leaves 20 and 22, such that the ring halves 16 are proximal ring halves that are closer to their respective opposing proximal ring halves 16 while the locking ring halves 18 are disposed further from each other. The leaves 20 and 22 are preferably stiff but flexible and resilient enough to be deformed by squeezing the locking ring halves 18 together as shown in FIG. 2, after the proximal ring halves 16 have contacted each other and they are in the pivoting direction about the longitudinal axis. Thus, in the locked position shown in FIGS. 8 and 9, the platform passes the proximal ring halves against each other, while passing the locking ring halves in a direction away from each other. As the binder is forced at the closed position, the proximal ring halves 16 have contacted each other preferably before the locking ring halves 18 contact each other.

As shown in FIG. 9, when the ring halves 16 and 18 are in a closed and locked position, the opposing ring halves cooperatively define a loop that is substantially capable of being closed within a hole punched stack of paper or the workpiece. As described, the locking portions 84 prevent pivoting of the ring assemblies away from the locked position towards the opened position.

Figure 6:
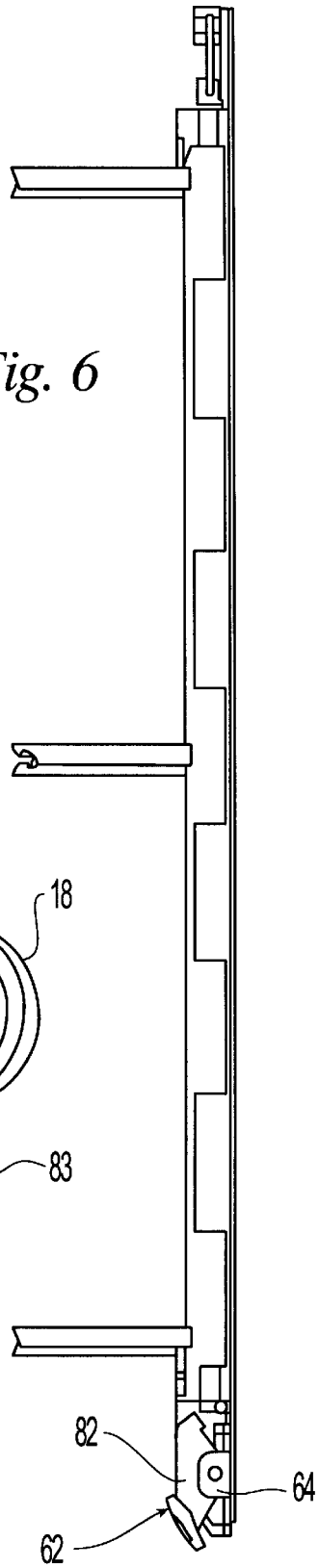
FIG. 6 is a side view thereof.

To open the binder, a user depresses a button 62, which pivots about pivot pin 72, and translates the leaves 20 in the unlocking direction. This displacement separates the locking portions 84 of locking ring halves 18, allowing the springs 42 to pivot the ring assemblies, including leaves 20 and 22 in an open direction in which the opposing pairs of ring halves no longer form a closed loop, but instead define a substantially opened loop to allow loading and unloading of paper or the workpiece. At least one of the ring assemblies is movable with respect to the other ring assembly in an unlocking direction oriented less than 180° from the longitudinal axis, still more preferably less than about 30° from the longitudinal axis, and most preferably less than about 10° from the longitudinal axis. Leaves 20 and 22 preferably are not forced against each other, and may have a gap between each other as shown in FIG. 8. The open position immediately after separation of the pairs of opposing ring halves while the button is still depressed is shown in FIGS. 5–7. The ring assemblies preferably move longitudinally with respect to each other by at least about half of the width of the ring halves. The locking portions are configured to disengage at least at this point. As can be seen, the locking portions 84 of the opposing locking ring halves 18 are longitudinally out of alignment, and have been displaced with respect to each other sufficiently to longitudinally move the locking portion 84 to clear the locking stop 88. In an alternative embodiment, we have different means of moving or sliding the ring assemblies with respect to each other longitudinally, such as a cam, a spring, or a handle that permits direct pulling of one or both of the ring assemblies. However, the system described with a translation blocking member, such as blocking portion 76, is preferred to prevent accidental opening of the binder mechanism that may be caused, for example, when the binder mechanism falls to the floor.

Figure 10:
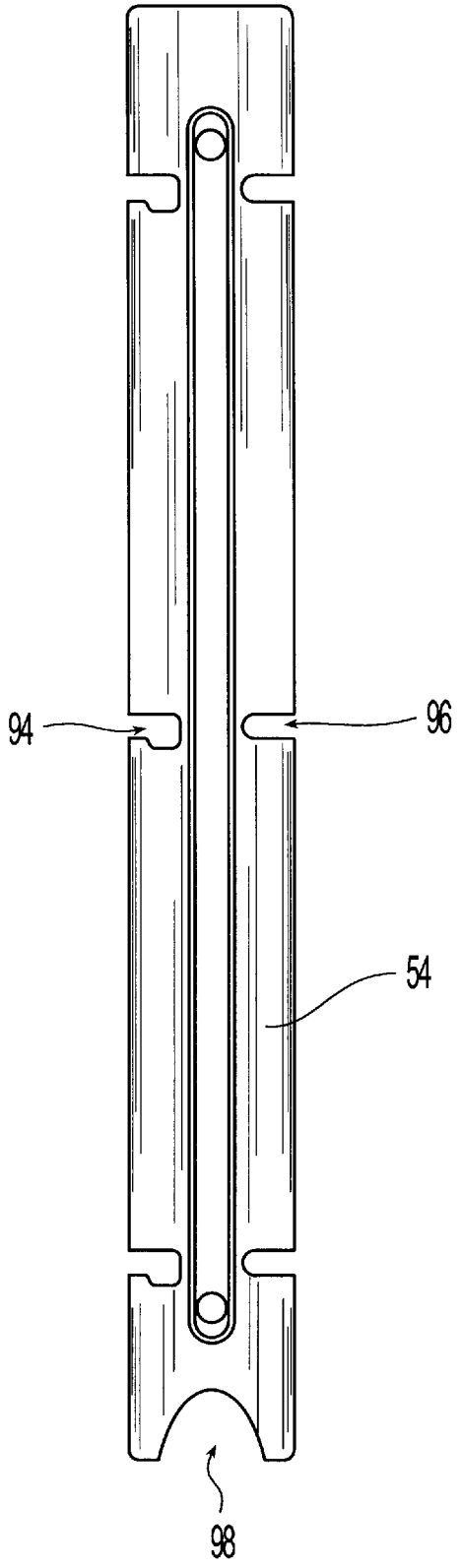
FIG. 10 is a top view of the cover of the binder mechanism.

Referring to FIG. 10, the cover 54 includes lateral slots 94 and 96 on the left and right sides thereof. The slots 96 preferably have a substantially uniform length such that the cover may be assembled to receive the ring halves 16 and 18 that are disposed on the right leaf 22, allowing them to pivot between the opened and closed positions about the longitudinal axis. The slots 94 on the left side of the cover, have a wire portion towards the interior of the slot to permit the ring halves 16 and 18 that are mounted to the left leaf 20 to transmit longitudinally therein. The cover also has a button recess 98 to expose the upper surface 66 of the button, to allow the user to suppress the button 62.

Referring to FIGS. 11–14, another embodiment 100 of the binder mechanism constructed according to the present invention includes a base 102, which is preferably interval construction and may be labeled as a unitary piece. Non-locking ring halves 104 and locking ring halves 106 are preferably pressed, otherwise secured to shafts 108 and 110. As shown in the figures, the free ends of the non-locking ring halves 104 comprise a chain of angled surfaces facing meshable angled surfaces in the opposing ring halves 104.

The shafts 108 and 110 are snapped into slots 112, which preferably perform as pushing to allow pivoting between locked and unlocked positions about a longitudinal axis of the shafts 108 and 110. Ring halves 104 and 106 are received through openings 114 and 116. Openings 114 are wider in the longitudinal direction than openings 116, to permit longitudinal sliding of the shaft 108 with respect to the base 102 and the shaft 110.

A translation spring 118, which is preferably a compression spring in this embodiment, but which may be an expanded spring in another embodiment, is disposed between preferably swaged barbs 120, which extend regularly from the shaft 108, and wall 122 of the base. Thus, spring 118 longitudinally biases the shaft 108 and the rest of the ring assembly in the locking longitudinal direction. Preferably, the end 144 of shaft 108 contacts the wall 146 of the base to prevent longitudinal movement of the shaft 108 past the point at which the opposing pairs of ring halves 104 and 106 are aligned with each other. This permits a user to compress the ring halves 104 and 106 together to lock them to each other, without requiring manual alignment. Torsion springs 124 are engaged with slots 126 in the shafts 108 and 110 and spring seat 128. The torsion springs bias the shafts 108 and 110 to rotate the ring halves 104 and 106 away from each other toward the open position. The locking ring halves 106 engage and lock the association to prevent this rotation.

Figure 11:
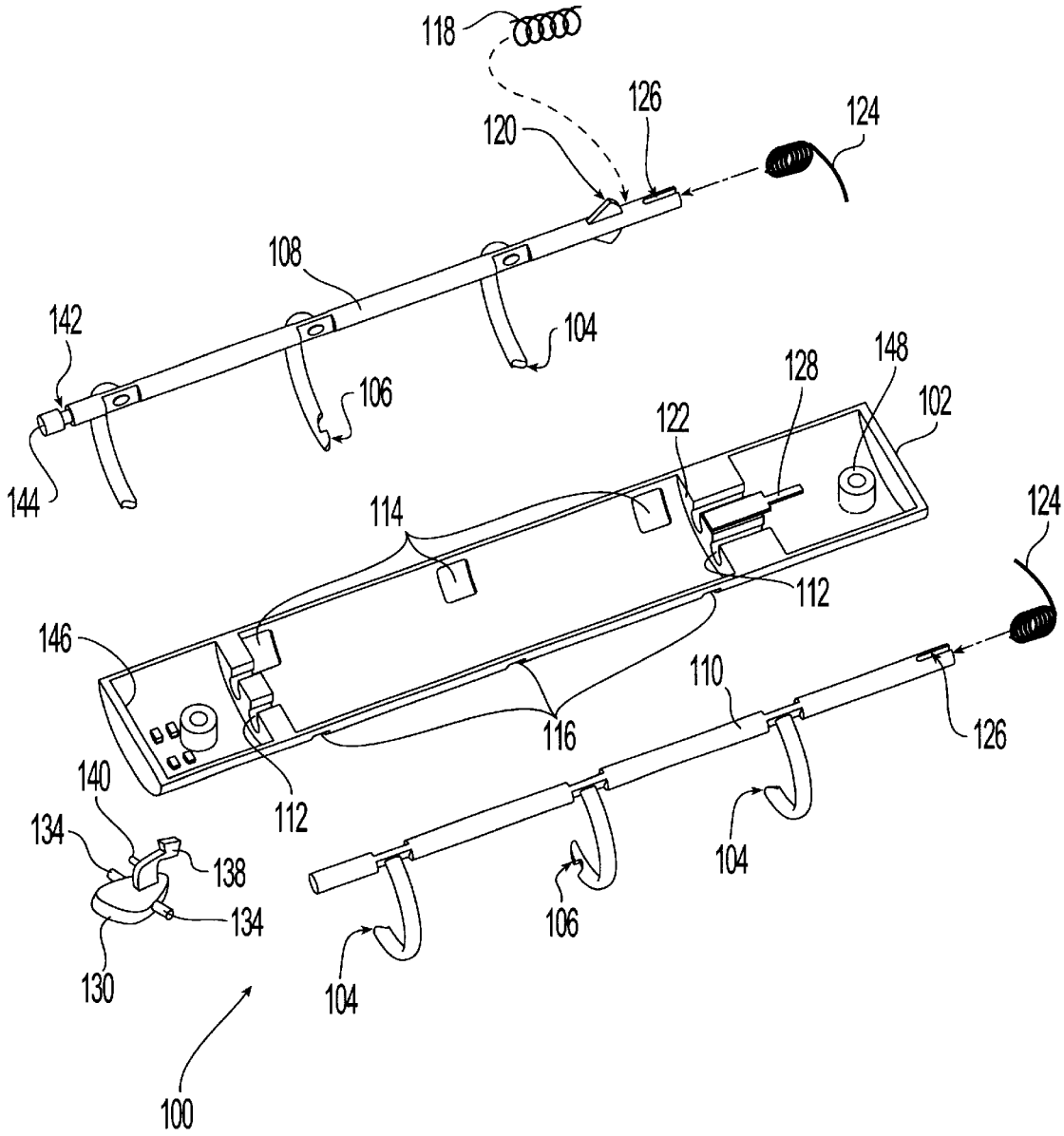
FIG. 11 shows the under side of an alternative embodiment of a binder construction constructed according to the present invention.
Figure 12:
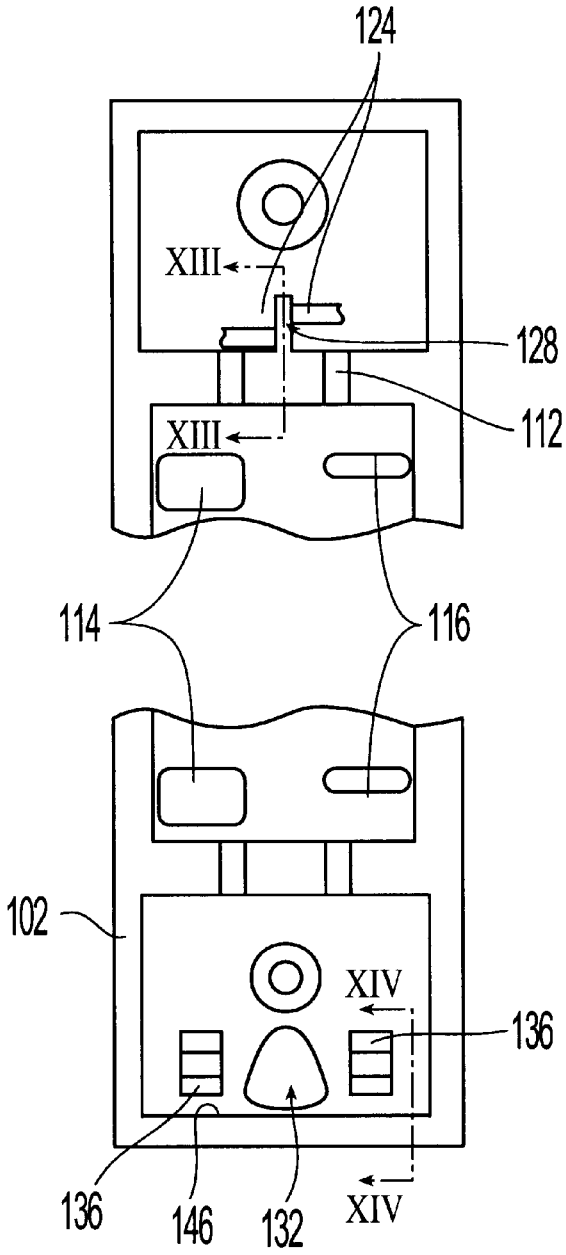
FIG. 12 is a cut-away bottom view of the base thereof.
Figure 13:
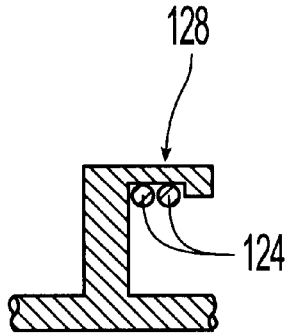
FIG. 13 is a cross-sectional view taken through line XIII—XIII.
Figure 14:
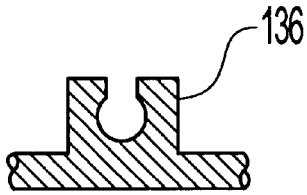
FIG. 14 is a cross-sectional view taken through line XIV—XIV.

Referring to FIG. 12, the button 130 is received through opening 132 on the top of the base and has pivot pins 134 which snap into brackets 136 of the base. The button spring preferably biases the button to an inactive position with respect to the base 102, similarly to the first embodiment. The button has a blocking portion 138, which preferably engages in an opening below, which is shown in FIG. 11. A ring assembly actuating portion 140 extends laterally from the button and is positioned with respect to the pivot pin 134 to engage slot 142 of shaft 108. When the button is depressed, it pivots about pivot pins 134, and the extension 140 forces the shaft 108 in an unlocking direction away from the button to disengage the locking portions of the locking ring halves and allow both shafts to rotate with their respective ring halves 104 and 106 to the open position.

The binder mechanisms 10 and 100 are preferably riveted or otherwise fixed, such as by gluing, screwing, or other known in the art, to a folder 83 shown in FIG. 7. A folder is not shown attached to the binder mechanism 100 of the second embodiment, however, post 148 preferably is provided in the interior of the base 102 to permit attachment to the spine or cover or other portion of the folder to produce a complete ring binder.

Although each embodiment includes platforms such as leaves 20 and 22 or shafts 108 and 110, that position opposing the locking ring halves in each pair pivotably further from each other than the non-locking ring halves, alternative embodiments may have certain locking ring half pairs positioned further from each than other locking ring half pairs. Still further embodiments may have all of the proximal ring halves in alignment with each other to contact each other at the same time when the binders are closed. The preferred embodiment, however, ensures that all of the ring halves will meet in the closed position upon squeezing the locking ring halves that are further apart or the distal pair of ring halves, to the closed position. Binder mechanisms constructed according to the present invention may provide easy closing without the proximal ring halves snapping together, as occurred in traditional binders in which the proximal ring halves are toggled through opened and closed positions. Also, the actuating button allows single handed opening of the binder rings. In an alternative embodiment, however, more than a single button may be provided, or more than a single means of opening the ring halves may be provided.

One of ordinary skill in the art can envision numerous variations and modifications. All of these modifications are contemplated by the true spirit and scope of the following claims.

What is claimed is:

1. A binder mechanism, comprising:

a first ring assembly that includes at least one first ring segment, and a binding portion;

a base comprising a first base portion pivotably connected to the first ring assembly, and a second base portion pivotably connected to the binding portion, the first ring assembly and the binding portion being pivotable about longitudinal axes to a locked position in which the first ring segment is engaged with binding portion cooperatively defining a loop that is substantially closed to retain a stack;

wherein the first ring assembly and the binding portion are lockable with respect to each other in the locked position to prevent pivoting of the pivotable portion from the locked position;

wherein first and second base portions connected to each other and movable substantially longitudinally with respect to each other in an unlocking direction to move the first platform and the binding portion with respect to each other from the locked position to permit the first ring assembly and binding portion to pivot about the longitudinal axes to an open position in which the loop is substantially open.

2. The binder mechanism of claim 1, further comprising a translation spring biasing the first base portion with respect to the second base portion in a locking direction against the unlocking direction to retain the first locking segment in locked association with the binding portion when in the locked position.

3. A binder mechanism, comprising:

(a) a first ring assembly being pivotable along a first longitudinal axis and including at least one first ring segment;

(b) a second ring assembly including at least one second ring segment disposed generally laterally from the first ring segment forming at least one ring segment pair therewith; and wherein the first and second ring assemblies are lockable with respect to each other in a locked position in which the ring segment pair defines a loop that is substantially closed to retain a stack;

wherein at least one of the first and second ring assemblies is movable with respect to the other to an unlocked position that is longitudinally spaced from the locked position and generally aligned with the longitudinal axis to permit the first ring assembly to pivot about the longitudinal axis to an open position in which the loop is substantially open.

4. A binder mechanism, comprising:

(a) a first ring assembly that includes a first platform and at least one first ring segment mounted to the first platform; and (b) a binding portion, at least one of the first ring assembly and the binding portion being a pivotable portion which is pivotable with respect to the other about a first longitudinal axis to a locked position in which the first ring segement is engaged with binding portion cooperatively defining a loop that is substantially closed to retain a stack;

wherein the first ring assembly and the binding portion are lockable with respect to each other in the locked position to prevent pivoting of the pivotable portion from the locked position;

wherein at least one of the first platform and the binding portion is movable with respect to the other from the locked position in an unlocking direction to permit the pivotable portion to pivot about the longitudinal axis to an open position in which the loop is substantially open, wherein the unlocking direction is generally aligned with the longitudinal axis and oriented non-orthogonally from the longitudinal axis.

5. The binder mechanism of claim 4, wherein the binding portion comprises a second ring assembly that includes at least one second ring segment disposed generally laterally from the first ring segment forming at least one ring segment pair, the ring segment pair forming the loop.

6. The binder mechanism of claims wherein the first ring assembly is resiliently biased towards the open position.

7. The binder mechanism of claim 4, wherein:

(a) the at least one first ring segment includes at least one first locking segment; and (b) the binding portion includes a second locking segment lockable to the first locking segment and unlockable therefrom upon movement in the unlocking direction of the at least one of the first ring assembly and the binding portion.

8. The binder mechanism of claim 4, further comprising a cam engageable with at least one of the first ring assembly and the binding portion upon pivoting of the pivotable portion about the longitudinal axis towards the locked position to cam the ring assemblies generally along the longitudinal axis to lock in the locked position.

9. The binder mechanism of claim 4, further comprising a base, the first ring assembly and the binding portion each being pivotably connected thereto.

10. The binder mechanism of claim 4, a lever connected between the first ring assembly and the binder portion such that rotation of the lever displaces the first ring assembly with respect to the binding portion in the unlocking direction.

11. The binder mechanism of claim 4, further comprising manipulable member connected between the first ring assembly and the binder portion such that movement of the manipulable member displaces the first ring assembly and binder portion with respect to each other in the unlocking direction, wherein the manipulable member has a blocking portion connected to block relative movement in the unlocking direction between the first ring assembly and the binding portion.

12. The binder mechanism of claim 4, wherein the unlocking direction oriented at less than about 30° from the longitudinal axis.

13. The binder mechanism of claim 4, wherein the unlocking direction oriented at less than about 10° from the longitudinal axis.

14. The binder mechanism of claim 4, further comprising a translation spring biasing the first ring assembly and the binding portion with respect to each other against the unlocking direction to retain the first locking segment in locked association with the binding portion when in the locked position.

15. The binder mechanism of claim 6, further comprising a spring connected between the first ring assembly and the binding member for biasing the first ring assembly towards the open position.

16. The binder mechanism of claim 7, wherein the binding portion comprises a second ring assembly that includes at least one second ring segment disposed generally laterally from the first ring segment forming at least one ring segment pair, the ring segment pair forming the loop, and the second ring segment including the second locking segment.

17. The binder mechanism of claim 7, wherein at least one of the first and second locking halves of the ring segment pair includes a protrusion and the other of the ring segment pair includes a stop, the protrusion being engageable against the stop in the locked position to prevent pivoting of the pivotable portion about the first longitudinal axis.

18. The binder mechanism of claim 7, wherein the at least one first ring segment includes a proximal ring segment disposed relative to the locking segment such that the proximal ring segment contacts the binding portion prior to the locking segment upon the pivoting of the pivotable portion towards the locked position.

19. The binder mechanism of claim 9, wherein the binding portion connected to the base pivotably about a second longitudinal axis substantially parallel to the first longitudinal axis.

20. The binder mechanism of claim 9, wherein the first ring assembly is pivotably connected to the base by a pinned hinge.

21. The binder mechanism of claim 9, further comprising a pivot spring resiliently biasing the first ring assembly with respect thereto towards the open position about the first longitudinal aixs.

22. A binder mechanism, comprising:

a first ring assembly that includes at least one first locking ring segment and a proximal ring segment; and a binding portion that includes a second locking segment, at least one of the first ring assembly and the binding portion being a pivotable portion which is pivotable with respect to the other about a first longitudinal axis to a locked position in which the first ring segments are engaged with binding portion cooperatively defining a loop that is substantially closed to retain a stack;

wherein the proximal ring segment is disposed relative to the locking segment such that the proximal ring segment contacts the binding portion prior to the locking segment upon the pivoting of the pivotable portion towards the locked position;

wherein second locking segment is lockable to the first locking segment in the locked position to prevent pivoting of the pivotable portion from the locked position and unlockable therefrom to permit the pivotable portion to pivot about the longitudinal axis to an open position in which the loop is substantially open.

23. A binder mechanism of claim 22, wherein the proximal ring segment is not lockable to the binding portion in the locked position.

24. The binder mechanism of claim 22, wherein the first ring assembly comprises a first platform to which the proximal and locking segments are mounted, the proximal ring segment being mounted on the platform closer to the binding portion than the locking segment in a pivoting direction about the longitudinal axis.

25. The binder of claim 24, wherein the platform is resiliently deformable such that in the locking position the platform biases the proximal segment against the binding portion and the locking segment away therefrom in the closed position.

26. The binder of claim 24, wherein the at least one proximal ring segment includes two proximal ring segments positioned on each side of the locking segment.

* * * * *

UNITED STATES PATENT AND TRADEMARK OFFICE
Certificate

Patent No. 6,293,722 B1 Patented: September 25, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Paul R. Holbrook, Buffalo Grove, IL; Kenneth John Bargo, Chicago, IL; John James Dwyer, Lakeville, IL; John Andrew Johnson, Seattle, WA; Timothy Edward McKeown, Glen Ellyn, IL; Rodney Hal Monson, Evanston, IL; and Balaji Kandasamy, Naperville, IL.

Signed and Sealed this Seventh Day of February 2006.

BOYER D. ASHLEY
*Supervisory Patent Examiner*
Art Unit 3722